US006521122B1

(12) United States Patent
Elliot et al.

(10) Patent No.: US 6,521,122 B1
(45) Date of Patent: Feb. 18, 2003

(54) DRAINAGE BASIN FILTER

(75) Inventors: Thomas B. Elliot, Mountlake Terrace, WA (US); Martin L. Vanberg, Bothell, WA (US)

(73) Assignee: T and M Tech Environmental Supply, Bothell, WA (US)

( * ) Notice: Subject to any disclaimer, the term of this patent is extended or adjusted under 35 U.S.C. 154(b) by 0 days.

(21) Appl. No.: 09/721,260

(22) Filed: Nov. 22, 2000

Related U.S. Application Data

(60) Provisional application No. 60/212,098, filed on Jun. 15, 2000.

(51) Int. Cl.[7] ..... E03F 5/06

(52) U.S. Cl. ..... 210/163; 210/165; 210/170; 210/237; 210/456; 404/4

(58) Field of Search ..... 210/163, 164, 210/170, 456, 470, 237, 165; 404/4, 5

(56) References Cited

U.S. PATENT DOCUMENTS 2,263,259 A * 11/1941 Boosey ..... 210/164
3,626,823 A * 12/1971 Toth
3,713,539 A * 1/1973 Thompson et al. ..... 210/164
4,261,823 A * 4/1981 Gallagher et al. ..... 210/164
4,419,232 A * 12/1983 Arntyr et al. ..... 210/164
5,372,714 A 12/1994 Logue, Jr.
5,980,740 A * 11/1999 Hams et al. ..... 210/170
6,200,484 B1 * 3/2001 Mc Innis ..... 210/164
6,214,216 B1 * 4/2001 Isaacson ..... 210/163
6,217,756 B1 * 4/2001 Martinez ..... 404/4

* cited by examiner

*Primary Examiner*—Christopher Upton
(74) *Attorney, Agent, or Firm*—Christensen O'Connor Johnson Kindness PLLC

(57) ABSTRACT

A filter assembly (20) for a drainage basin (22) is disclosed. The filter assembly includes a filter (28), a liquid director (32) adapted to guide liquid into the filter. The filter assembly also includes an attachment assembly (30) fastened to the filter. The attachment assembly adapted to selectively attach the filter to the drainage basin.

10 Claims, 5 Drawing Sheets

DRAINAGE BASIN FILTER

RELATED APPLICATION

This application claims priority of the earlier filing date from Provisional Application No. 60/212,098, filed on Jun. 15, 2000, the disclosure of which is expressly incorporated herein by reference.

FIELD OF THE INVENTION

The invention relates generally to drainage basin filters and, more particularly to a removable filter for drainage basins.

BACKGROUND OF THE INVENTION

Drainage basins collect storm water from rain fall or melting snow. City sidewalks, streets, and roads are constructed such that surface water flows to strategically placed drainage basins. Typically, water collected by a drainage basin flows directly into the local sewer system, where it is channeled to a waste water treatment facility by a sewer line. As a result, water entering the sewer line should be free from solids and other debris that may cause clogging.

Many conventional sewer filters are located at or above the grade level of the roadway. As located, such filters remove solids from drainage water before it flows into the drainage basin. These filters may be placed horizontally on top of the grate, or are vertically disposed in a circle above the grade level surrounding the grate. Over time, solids can clog such conventional filters and impede the flow of water, thereby resulting in flooding of the surrounding area. Moreover, locating conventional sewer filters at grade level makes it difficult to drive or walk over the top of the drainage basin without damaging the filter.

Other existing drainage basin filters, known as below-grade drainage basin filters, are located below grade level. When such filters are full, they are too heavy to be removed by one person. Many parts of these below-grade drainage basin filters are not replaceable, thereby making them more expensive to maintain over time. Moreover, such below-grade filters can not be custom tailored to meet changing engineering specifications.

Prior to applying a layer of asphalt to the road, runoff typically pools around the drainage basin's grate due to an inability to enter the drainage basin at an area below the grate. The present invention offers a solution to this problem by positioning an inlet at a predetermined level below the drainage basin grate and outside of the cavity defined by the rim of the drainage basin.

For each of the foregoing reasons, there is a need for a below-grade drainage basin filter able to filter solids without impeding the free flow of water and adapted for easy removal, and maintenance.

SUMMARY OF THE INVENTION

In accordance with the present invention, a filter assembly for a drainage basin is provided. The filter assembly includes a filter, a liquid director adapted to guide liquid into the filter, and an attachment assembly fastened to the filter. The attachment assembly is adapted to selectively attach the filter to the drainage basin. In certain embodiments, the attachment assembly includes a support member attached to a first end of the filter and a hanger assembly adapted to selectively attach the filter assembly to a portion of the drainage basin.

In accordance with further aspects of this invention, the hanger assembly includes one end fastened to the support member. A second end of the hanger assembly is adapted to be coupled to the drainage basin to hang the filter at a predetermined location within the drainage basin and collect liquid from the liquid connector. The hanger assembly includes three support rods having first and second ends, wherein each support rod is adapted to be placed in one of three holes of the support member at the first end and sharing a common connecting point at the second end. The attachment assembly also includes a hanger arm extending from the common connecting point and adapted to be selectively affixed to the drainage basin by connecting means.

In accordance with other aspects of this invention, the liquid director is a conduit extending between the filter and the drainage basin to collect liquid and channel the liquid into the filter.

In accordance with still yet other aspects of this invention, the liquid director is adapted to substantially seal the drainage basin to channel liquid passing through the drainage basin into the filter.

A filter assembly formed in accordance with the present invention has several advantages over currently available filters. First, such filters are more environmentally reliable than existing filters because they are selectively attachable to the drainage basin, thereby minimizing the risk of dropping the filter or its contents into the drainage basin during cleaning. Second, because the liquid director physically channels fluids into the filter, such a filter is more effective at filtering waste water. Finally, because the filter is selectively attachable to the drainage basin, it is easier by a single person to clean or replace.

Thus, a filter assembly for a drainage basin formed in accordance with the present invention is environmentally reliable and efficient, and is easily maintained and replaced by a single operator.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
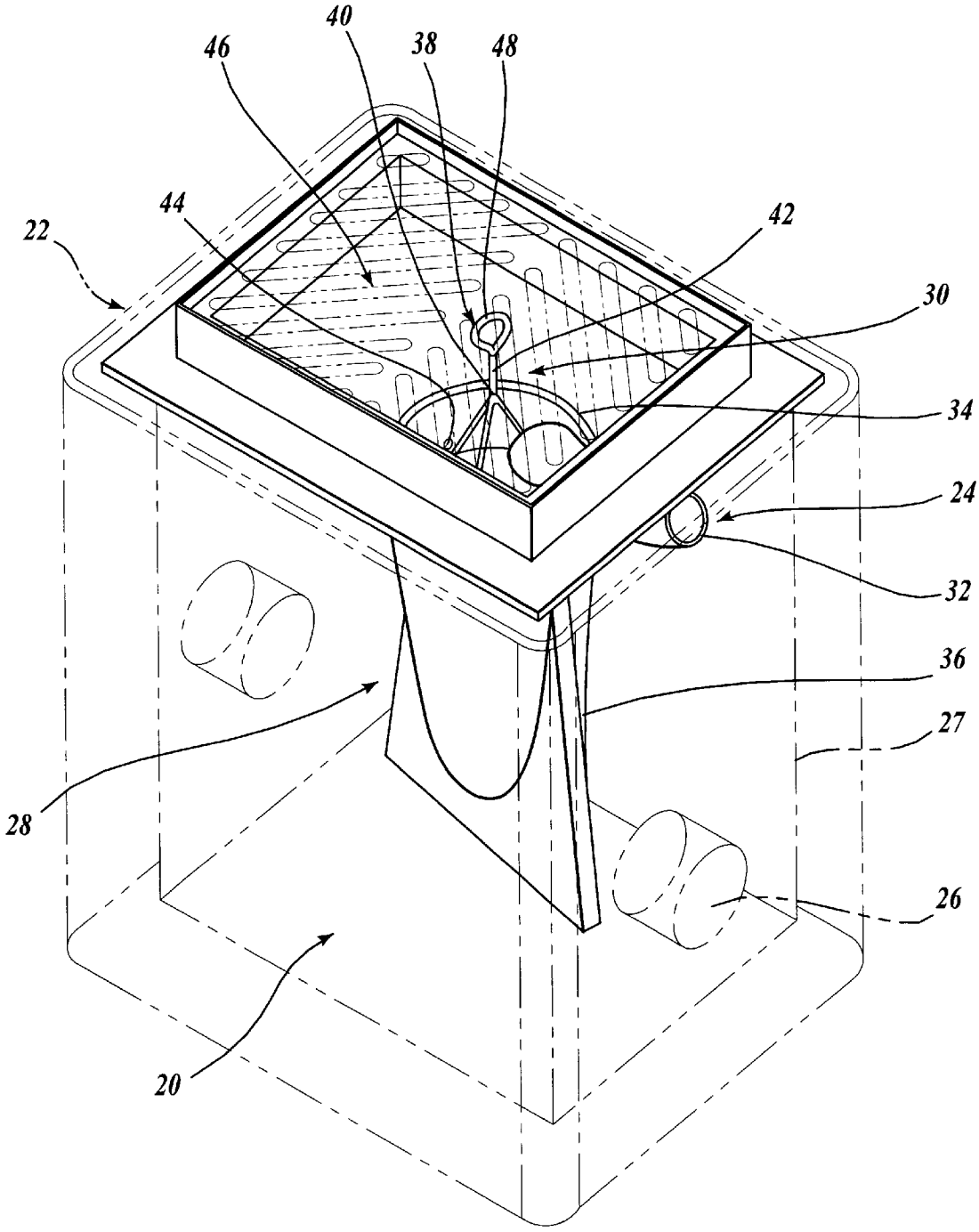
FIG. 1 is a perspective view of a drainage basin filter constructed in accordance with one embodiment of the present invention showing the drainage basin filter selectively attached to a drainage basin.

FIGS. 1–4 illustrate a filter assembly 20 constructed in accordance with one embodiment of the present invention. The filter assembly 20 is illustrated as being selectively attached to a drainage basin 22 disposed within a roadway (not shown). It should be apparent that the filter assembly 20 may be disposed within the drainage basin 22 either before a layer of asphalt is applied to the roadway, or after the roadway has been sealed by asphalt.

The drainage basin 22 is a substantially rectangular member and is suitably formed from a high strength material, such as concrete. The drainage basin 22 includes an inlet 24 and outlet 26 extending through sidewalls 27 of the drainage basin. The inlet 24 is a bore located near the top end of the drainage basin 22. Similarly, the outlet 26 is a bore extending through the at least one sidewall 27 of the drainage basin 22 and is suitably located near the bottom of the drainage basin 22.

Figure 2:
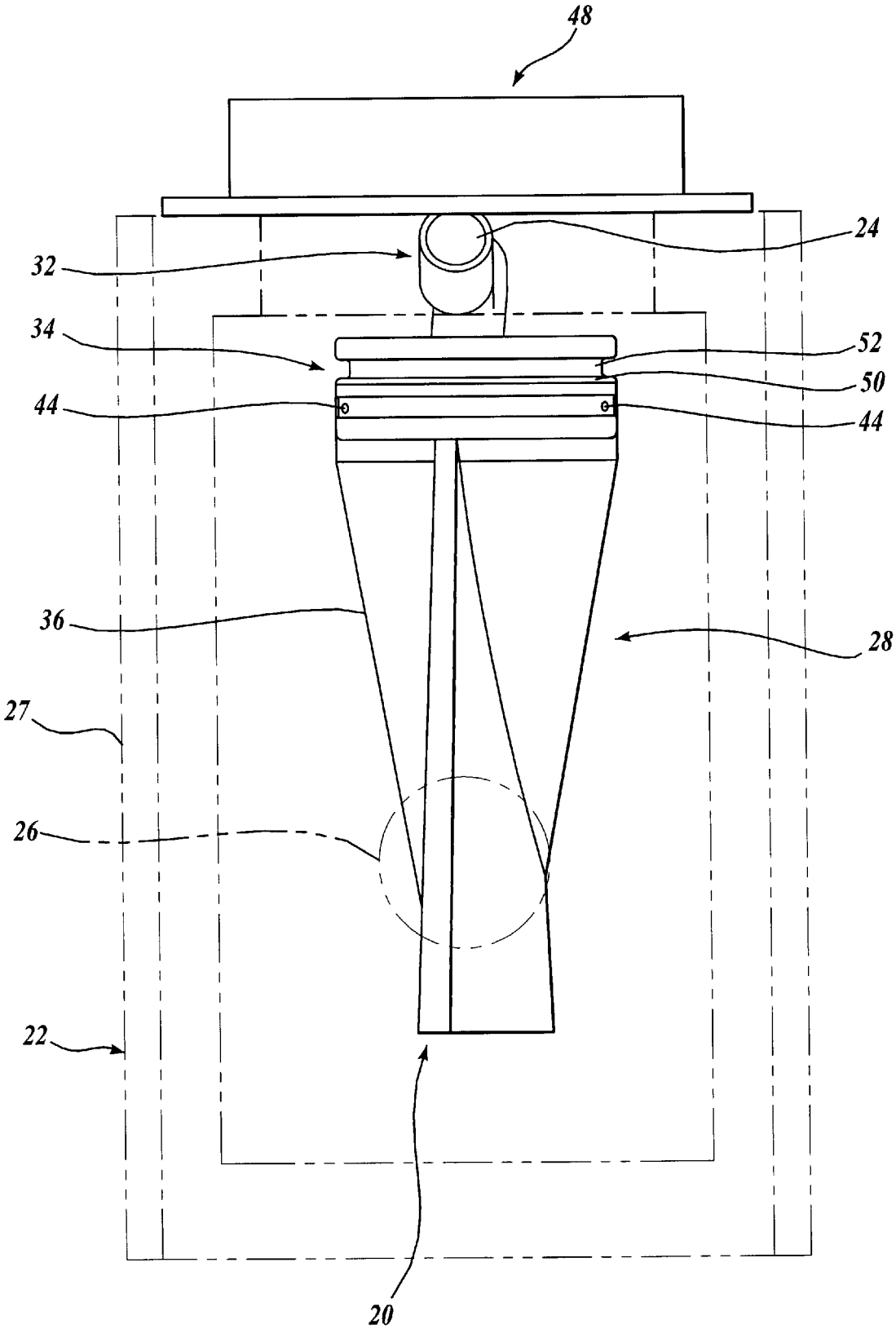
FIG. 2 is a side planar view of a drainage basin filter constructed in accordance with one embodiment of the present invention showing the drainage basin filter selectively attached to a drainage basin.

As best seen by referring to FIG. 2, the filter assembly 20 includes a filter 28, a support assembly 30, and a liquid director 32. The filter 28 includes a support member 34 and a filter material 36. The support member 34 is suitably formed from woven fabric, or a comparable material. Such comparable materials include nonwoven fabrics, punctured burlap or hemp, woven cotton, punctured plastic, plastic mesh, woven steel mesh, punctured aluminum mesh, drilled stainless steel, or wire mesh. The filter material 36 is preferably tapered from an upper end to its lower end, such that it has a substantially inverted triangular shape. Although such a tapered shape is not required for the invention, it is advantageous to have such a shape to allow liquid to pass through the drainage basin 22 unimpeded by the filter material 36.

The support member 34 is suitably an annular member formed from polypropylene or a comparable material, such as aluminum, steel, stainless steel, copper, or wood. Although an annular support member 34 is preferred, it should be apparent that other shapes, such as rectangular or square, are also within the scope of the present invention.

Figure 3:
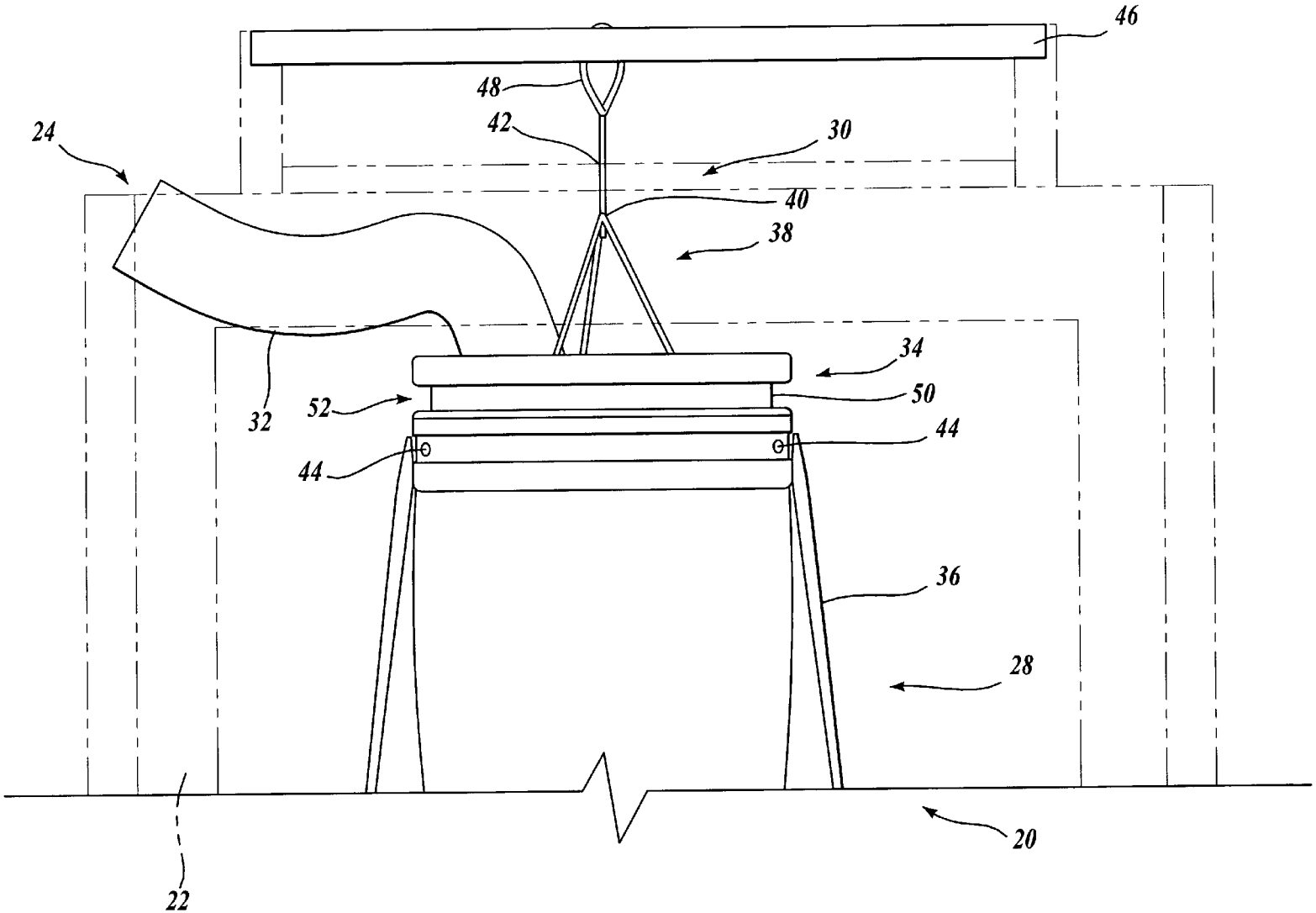
FIG. 3 is a partial planar side view of a drainage basin filter constructed in accordance with one embodiment of the present invention showing the drainage basin filter selectively attached to a drainage basin.

Referring to FIG. 3, the support assembly 30 will now be described in greater detail. The support assembly 30 includes a three-pronged support bracket 38, a connecting point 40, and an attaching cord 42. The three-pronged support bracket 38 extends from the common connecting point 40 and is adapted to be placed inside support ring holes 44 located in the support member 34. The three-pronged support bracket 38 may be formed from nylon or a comparable material, such as cable, wire, plastic, chain, aluminum, copper, steel, rope, cotton, dagron, polyester, Gore-Tex™, or rubber.

The connecting point 40 may be formed from steel or a comparable material such as aluminum, brass, zinc, gold, silver, platinum, rubber, plastic, stainless steel, nickel, or titanium. Such a connecting point 40 may be a well known caribeiner. The three-pronged support bracket 38 and the connecting point 40 are attached to an attaching member 42 extending between the connecting point 40 and a grate 46 of the drainage basin 22. The support bracket 38 is coupled to the grate 46 by a loop 48 or other suitable connecting apparatus.

The attaching cord 42 is suitably formed from nylon or a comparable material, such as cable, wire, plastic, chain, aluminum, copper, steel, rope, cotton, dagron, polyester, Gore-Tex™, or rubber. The attaching cord 42, connecting point 40, and three-pronged support bracket 38 may be fastened together by compression clamps.

Still referring to FIG. 3, external fluids are directed into the filter 28 by the liquid director 32. The liquid director 32 is suitably a tubular structure formed from ABS plastic or HDPP, vinyl, rubber, plastic, aluminum, steel, fiberglass, copper or nylon. Such external fluids may be directed into the liquid director 32 by the slope of the roadway or other surface in which drainage basin 22 is mounted.

The material from which the filter material 36 is constructed should be adapted to allow the free flow of water and the capture of solids such as silt. The filter 28 is emptied by lifting and emptying the contents, and then reinstalling it in the drainage basin.

Figure 4:
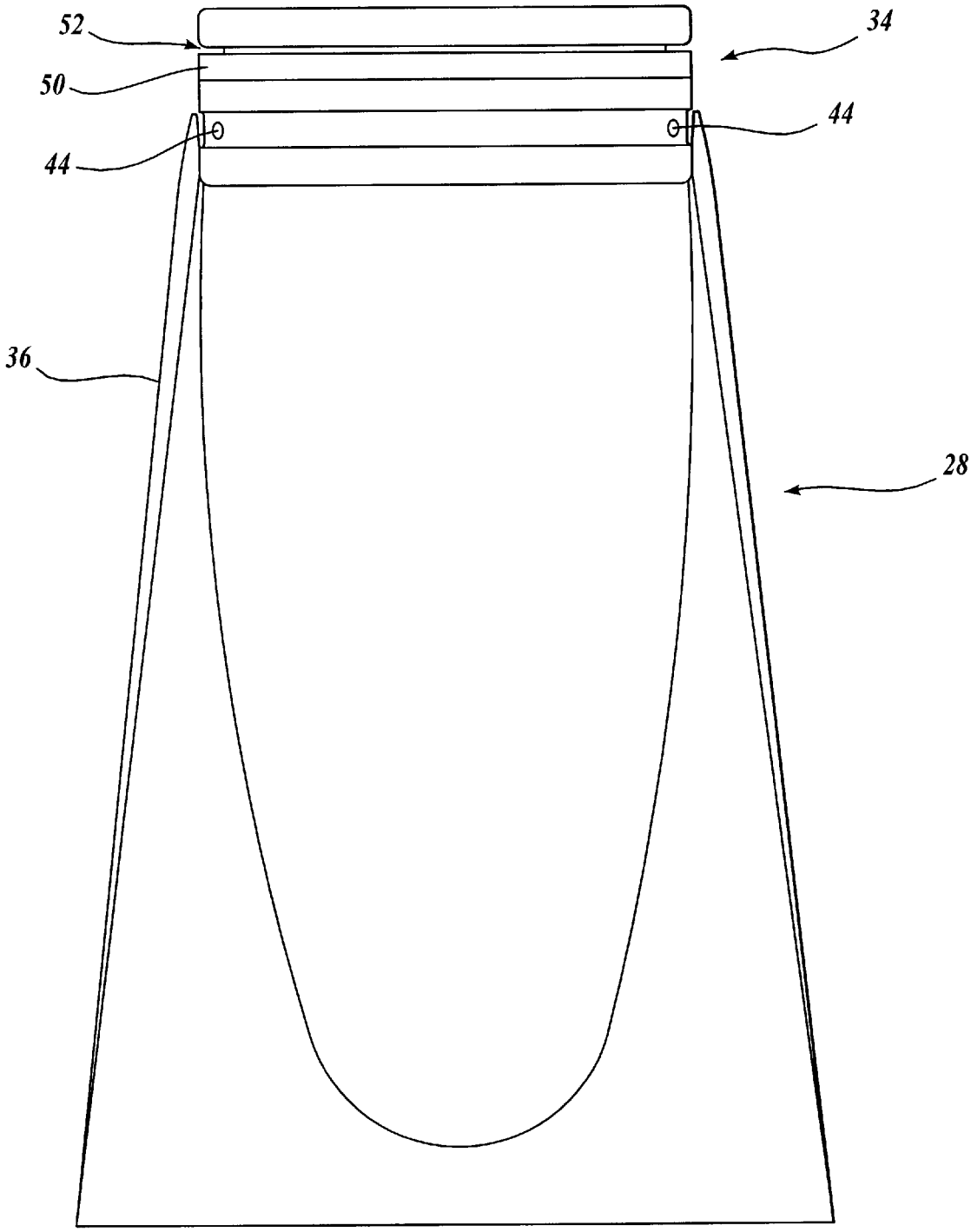
FIG. 4 is a side planar view of a filter assembly for a drainage basin filter formed in accordance with one embodiment of the present invention.

As seen best in FIG. 4, the filter 28 is constructed by placing the filter material 36 around the circumference of the support member 34 and placing a fastening cord 50 around the support member 34 and tightening the fastening cord 50, such that both the fastening cord 50 and filter material 36 rest firmly in groove 52. The fastening cord 50 is made of nylon, steel, cable, rubber, plastic, chain, aluminum, hemp or copper.

Figure 5:
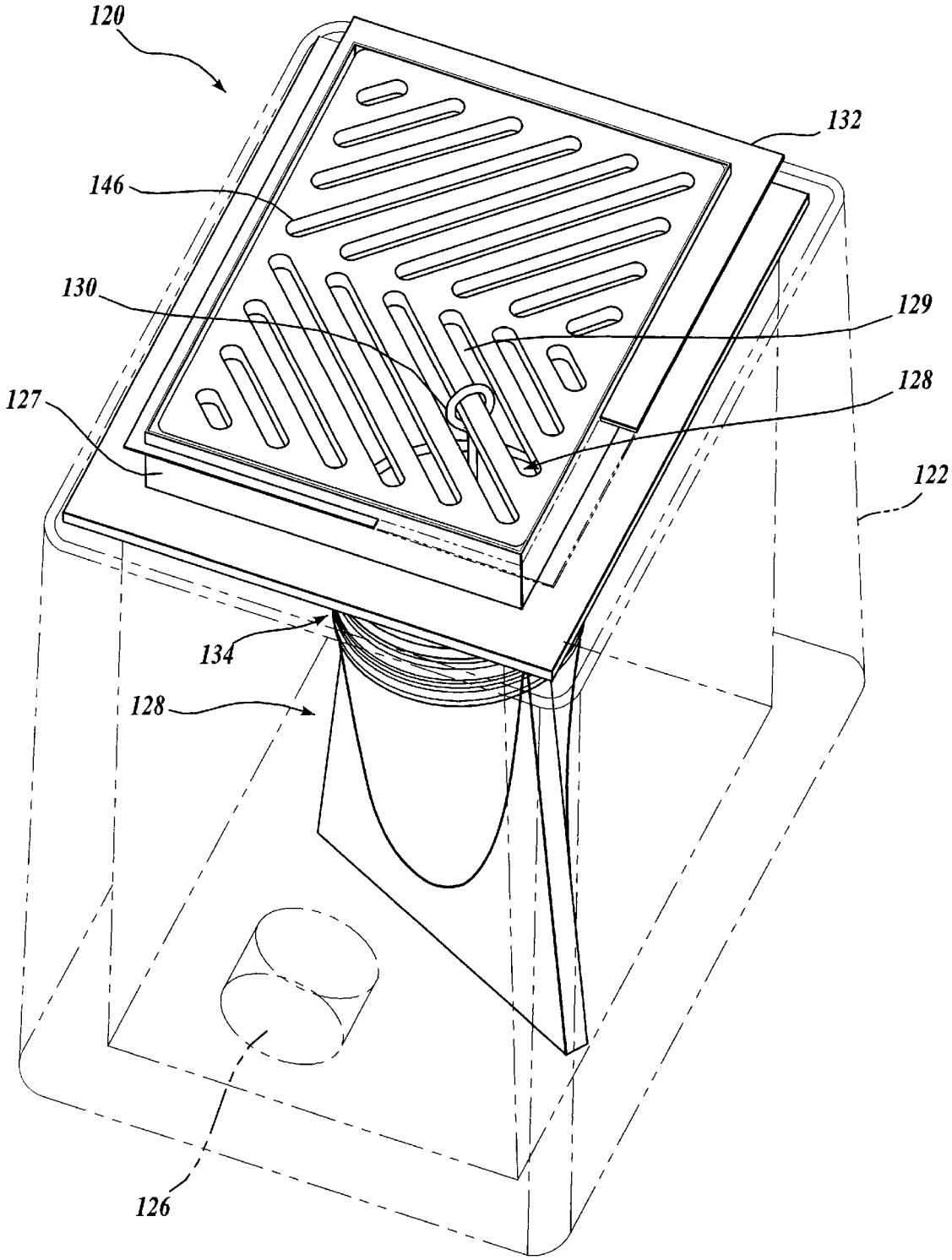
FIG. 5 is a perspective view of a drainage basin filter constructed in accordance with a second embodiment of the present invention showing the drainage basin filter selectively attached to a drainage basin.

Referring now to FIG. 5, a filter assembly 120 constructed in accordance with another embodiment of the present invention will now be described in greater detail. As a non-limiting example, this alternate embodiment is suitably used when a final layer of asphalt has been applied to the roadway, or when the ground grade meets the top of the drainage basin 122. The filter assembly 120 is substantially identical in materials and operation to the filter assembly 20 described above, except that the liquid director 32 is replaced by a substantially planar liquid director 132.

Instead of a tubular structure, the liquid director 132 is suitably a planar member, such as a tray. The liquid director 132 is adapted to be placed between the grate 146 and sidewalls 127 of the drainage basin 122, such that the liquid director 132 substantially seals the upper end of the drainage basin 122 to channel liquid passing through the grate 146 into the filter assembly 120. To facilitate channeling of liquid into the filter assembly 122, a portion of the liquid director 132 has been cut away to form an opening 129 in one of the corners of the liquid director 132. Although it is preferred that the opening 129 be formed in a corner of the liquid director 132, other positions of the opening 129, such as a centrally located opening, are also within the scope of the present invention.

The liquid director 132 is suitably constructed from plastic or a comparable material, such as woven fabrics, nonwoven fabrics, geotextile fabrics, rubber, steel, stainless steel, aluminum, copper, Teflon®, foil, wood, injection-molded plastic, or fiberglass. A filter assembly 120 formed in accordance with the alternate embodiment includes the same filter 128 and support assembly 130 as described above for the first embodiment (FIGS. 1–4).

Silt catchers formed in accordance with the present invention have several advantages over those currently available in the art. First, such catchers are easier to remove and clean by one person. Second, a catcher of the present invention has reusable parts, and therefore, is cost efficient. Finally, a silt catcher of the present invention may be custom tailored to meet engineering specifications.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A combination filter assembly and drainage basin, comprising:

(a) a drainage basin having sidewalls and a grate defining a grate;

(b) a filter;

(c) a liquid director having an inlet, said inlet being positioned outside of the cavity and below said grate and adapted to receive fluid flowing on a surface below said grate, and extending between at least a portion of the drainage basin and the filter to guide liquid into the filter; and (d) attachment means fastened to the filter for selectively attaching the filter to a drainage basin.

2. The combination filter assembly and drainage basin of claim 1, wherein the filter is tapered from a first end to a second end.

3. The combination filter assembly and drainage basin of claim 1, wherein the attachment means comprises a support member attached to a first end of the filter and a hanger assembly selectively attaching the filter assembly to a portion of the drainage basin.

4. The combination filter assembly and drainage basin of claim 3, wherein the hanger assembly includes one end fastened to the support member and a second end selectively coupled to the drainage basin to hang the filter at a predetermined location within the drainage basin and collect liquid from the liquid director.

5. The combination filter assembly and drainage basin of claim 3, wherein the hanger assembly comprises:

(a) three support rods having first and second ends, each support rod is adapted to be placed in one of three holes of the support member at the first end, and sharing a common connecting point at the second end; and (b) a hanger arm extending from the common connecting point and selectively affixed to the drainage basin by connecting means.

6. The combination filter assembly and drainage basin of claim 1, wherein the liquid director is a conduit.

7. A filter assembly for a drainage basin having a cavity wherein at least one surface is defined by a grate, the filter assembly comprising:

(a) a filter;

(b) an attachment assembly fastened to the filter, the attachment assembly adapted to be selectively coupled to the drainage basin; and (c) guide means for directing liquid into the filter, said guide means including an inlet, said inlet being positioned at a predetermined level below said grate and outside of the cavity so as to receive fluid flowing on a surface below said grate.

8. The filter assembly of claim 7, wherein the guide means is a conduit adapted to extend between the filter and a drainage basin to channel liquid into the filter.

9. The filter assembly of claim 7, wherein the filter is positioned below the guide means to filter liquid passing through the guide means.

10. The filter assembly of claim 7, wherein the filter is tapered from a first end to a second end.

* * * * *